US008922297B2

(12) United States Patent
Stoneback et al.

(10) Patent No.: US 8,922,297 B2
(45) Date of Patent: Dec. 30, 2014

(54) MULTI-CONDUCTOR TRANSMISSION LINES FOR CONTROL-INTEGRATED RF DISTRIBUTION NETWORKS

(75) Inventors: Matthew A. Stoneback, Seattle, WA (US); Daniel J. Sego, Shoreline, WA (US)

(73) Assignee: The Boeing Company, Chicago, IL (US)

( * ) Notice: Subject to any disclaimer, the term of this patent is extended or adjusted under 35 U.S.C. 154(b) by 577 days.

(21) Appl. No.: 13/166,739

(22) Filed: Jun. 22, 2011

(65) Prior Publication Data

US 2012/0326802 A1 Dec. 27, 2012

(51) Int. Cl.
*H01P 3/00* (2006.01)

(52) U.S. Cl.
CPC . *H01P 3/00* (2013.01); *H01P 3/003* (2013.01)
USPC ..... 333/136; 333/172; 333/161

(58) Field of Classification Search
USPC ..... 333/136, 27, 138, 33, 172, 32, 185, 333/156, 161
See application file for complete search history.

(56) References Cited

U.S. PATENT DOCUMENTS 1,792,479 A * 2/1931 Bennett et al. ..... 109/38
4,609,889 A * 9/1986 Kumar ..... 333/100
4,611,184 A * 9/1986 Kumar ..... 333/100
4,631,492 A * 12/1986 Magarshack et al. ..... 330/277
4,636,754 A * 1/1987 Presser et al. ..... 333/116
6,650,199 B2 * 11/2003 Dobrovolny ..... 333/103
8,014,731 B2 * 9/2011 Block et al. ..... 455/78
2007/0228520 A1 * 10/2007 Winn et al. ..... 257/580
2009/0251232 A1 10/2009 Ding et al.
2010/0109803 A2 * 5/2010 Dupuy et al. ..... 333/136
2010/0265007 A1 10/2010 Wang et al.

OTHER PUBLICATIONS

PCT, International Search Report and Written Opinion, International Application No. PCT/US2012/038862 (Aug. 13, 2012).
D. D. Grieg and H. F. Engelmann, Microstrip—a New Transmission Technique for the Kilomegacycle Range, Proceedings of the I.R.E., vol. 40 No. 12, pp. 1644-1650 (1952), Institute of Radio Engineers, New York, NY.

(Continued)

*Primary Examiner* — Stephen Jones
*Assistant Examiner* — Scott S Outten
(74) *Attorney, Agent, or Firm* — Kevin G. Fields

(57) ABSTRACT

A multiple conductor radio-frequency transmission line including a plurality of conductive traces, an input port, and at least one output port is disclosed. The input port includes a radio-frequency signal input line which is generally aligned with and disposed in a partially or completely overlapping relationship with the plurality of conductive traces at the input port, with the radio-frequency signal input line being at least as wide as the plurality of conductive traces at the input port. The output port includes a radio-frequency signal output line which is generally aligned with and disposed in a partially or completely overlapping relationship with at least one of the plurality of conductive traces at the at least one output port, with the radio-frequency signal output line being at least as wide as the at least one of the plurality of conductive traces at the output port. The input and output ports provide a capacitively coupled, multi-conductor structure capable of simultaneously distributing primary radio-frequency signals and secondary control signals from the input port to one or more output ports in systems such a phased array radars and wireless communications systems.

19 Claims, 14 Drawing Sheets

(56) References Cited

OTHER PUBLICATIONS

Cao, Wei; Harrington, R.F.; Mautz, J.R.; Sarkar, T.K., "Multiconductor Transmission Lines in Multilayered Dielectric Media," IEEE Transactions on Microwave Theory and Techniques, vol. 32 No. 4, pp. 439-450 (1984), IEEE Microwave Theory and Techniques Society, New York, NY.

* cited by examiner

MULTI-CONDUCTOR TRANSMISSION LINES FOR CONTROL-INTEGRATED RF DISTRIBUTION NETWORKS

FIELD

The present disclosure is directed to transmission lines for the distribution of radio-frequency energy in networks used in, for example, phased array antenna systems, and, most particularly, to a multiple conductor radio-frequency transmission line which includes an input port adapted to capacitively couple a primary radio-frequency signal to a plurality of conductive traces carrying secondary control signals and, optionally, DC power.

BACKGROUND

Multiple types of mobile sensing platforms, including aircraft, marine vessels, and vehicle-mounted or vehicle-towed systems, make use of phased array antennas for remote sensing and communication. Modern active electrically scanned array ("AESA") systems typically use multiple isolated radio-frequency, control signal, and power transmission lines to distribute primary high frequency (microwave or "RF") signals, secondary low frequency control signals, and DC power to the individual antenna elements of an array. The need for multiple isolated transmission lines or "manifolds" is typically met by providing different conductive paths which occupy different footprints in a common plane or layer, by providing different conductive paths which share a common footprint in different planes or layers (typically separated by a layer of metalized dielectric material), or by a combination of these features. The use of separate manifolds is a significant factor affecting the weight and profile of current AESA technology. If the weight and size, particularly the profile or thickness, of an AESA system could be reduced, such systems could be more readily employed on payload limited sensing platforms such as unmanned aerial vehicles ("UAVs"), as well as in improved versions of existing sensing platforms. The multi-conductor transmission line structures disclosed herein may be used to substantially replace the separate manifolds described above, as well as to improve wireless communications systems employing a combination of high frequency RF energy for distant communications, low frequency energy for internal signaling and/or control, and DC power distribution for the powering of constituent subsystems.

SUMMARY

According to one aspect, a multiple conductor radio-frequency transmission line includes a plurality of conductive traces, an input port, and at least one output port. The input port includes a radio-frequency signal input line which is generally aligned with and disposed in a partially overlapping relationship with the plurality of conductive traces at the input port, with the radio-frequency signal input line being at least as wide as the plurality of conductive traces at the input port. The output port includes a radio-frequency signal output line which is generally aligned with and disposed in a partially overlapping relationship with at least one of the plurality of conductive traces at the at least one output port, with the radio-frequency signal output line being at least as wide as the at least one of the plurality of conductive traces at the output port. The input and output ports thus provide a capacitively coupled, multi-conductor structure capable of simultaneously distributing primary radio-frequency signals and secondary control signals from the input port to one or more output ports.

According to another aspect, a multiple conductor radio-frequency transmission line includes a plurality of conductive traces forming an impedance matched conduit for the transmission of a high frequency radio signal along electrically independent paths, a capacitively coupled input port, and a capacitively coupled output port. The capacitively coupled input port provides high-pass coupling of a high frequency radio signal between the plurality of conductive traces and a radio-frequency signal input line. The capacitively coupled output port provides high-pass coupling of the high frequency radio signal between the plurality of conductive traces and a radio-frequency signal output line. The radio-frequency signal input line is generally aligned with and at least as wide as the plurality of conductive traces at the input port; and the radio-frequency signal output line is generally aligned with and at least as wide as the plurality of conductive traces at the output port.

DETAILED DESCRIPTION

Figure 1A:
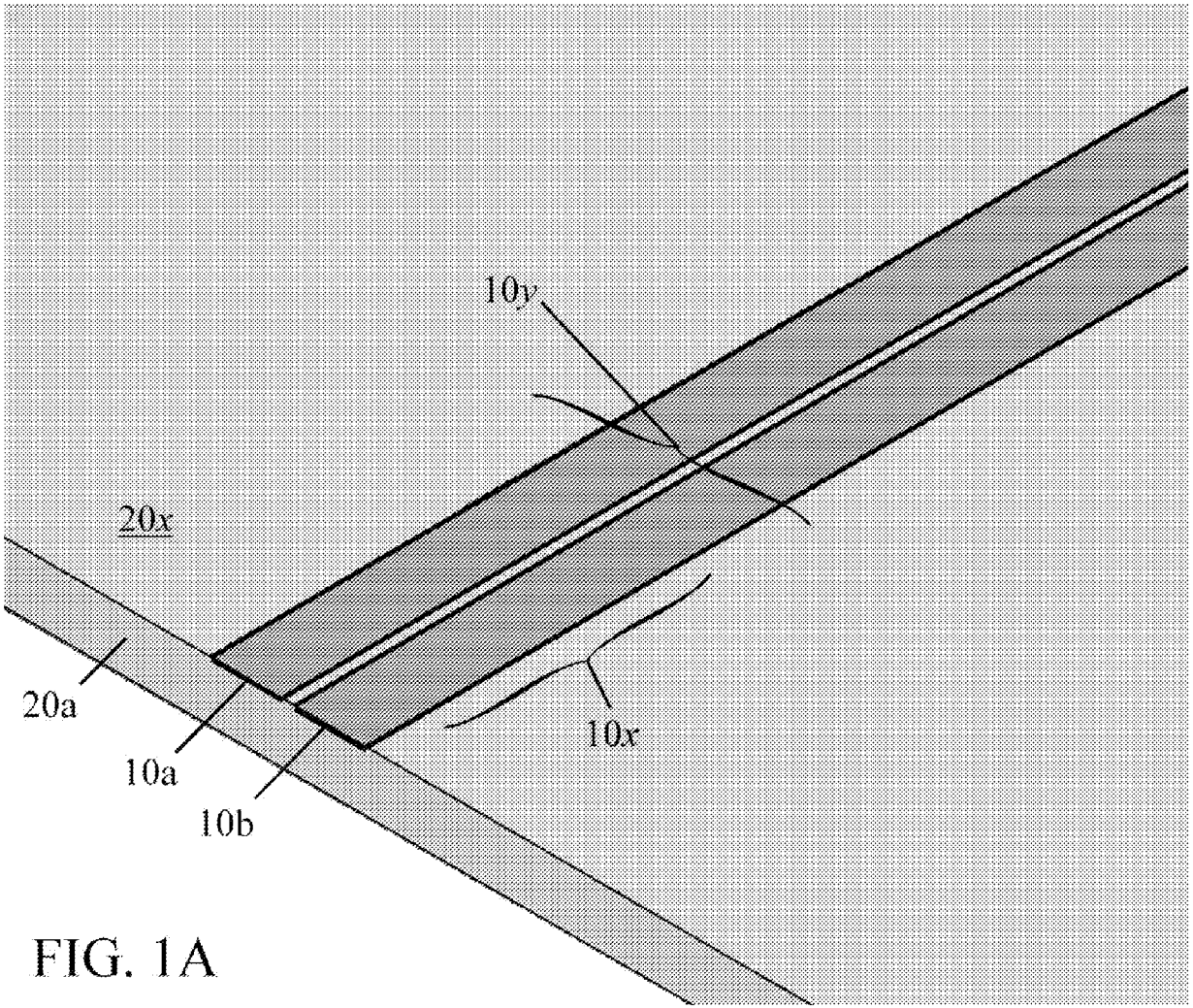
FIG. 1A is an illustration of a two conductor radio-frequency transmission line.
Figure 1B:
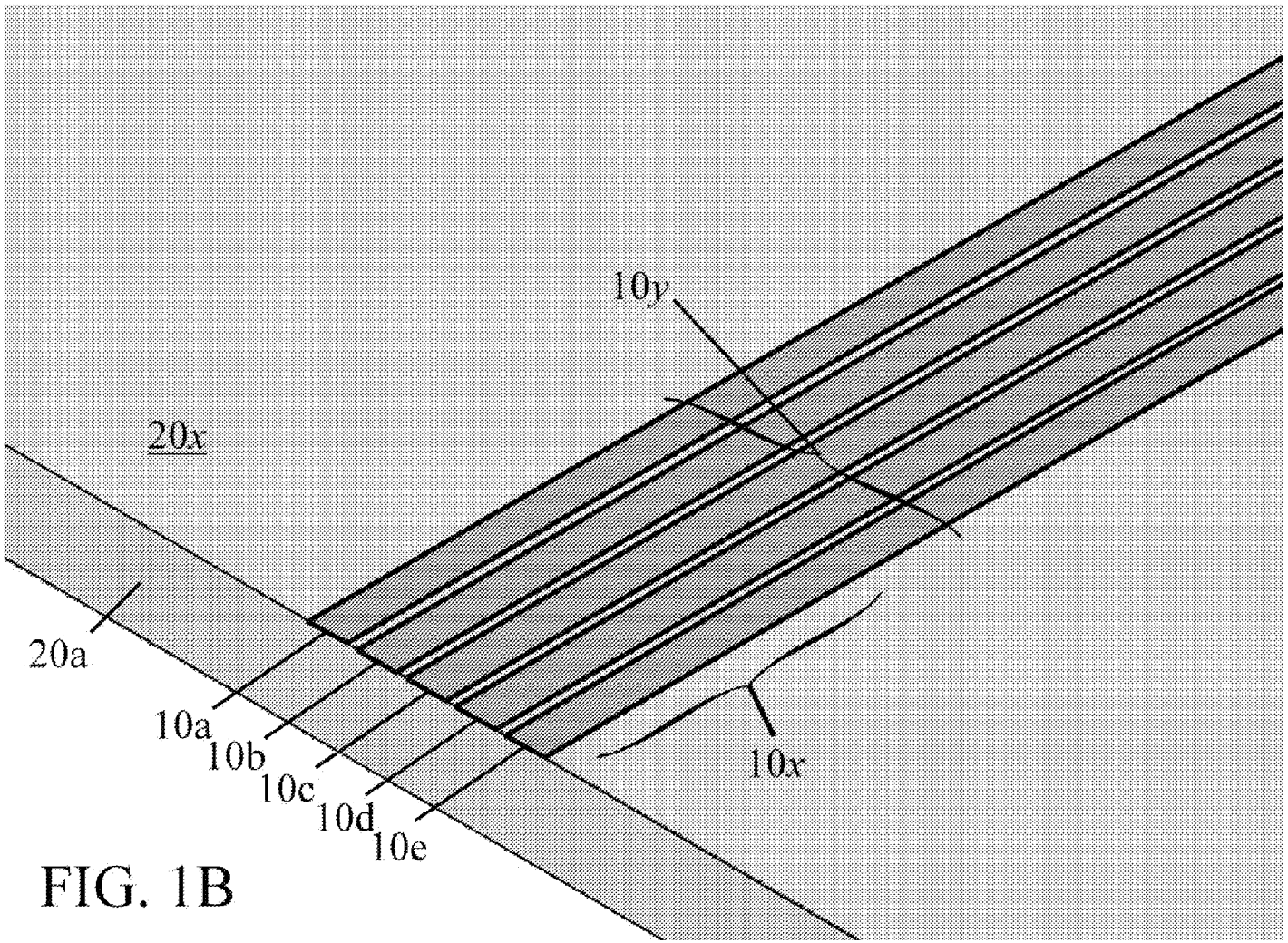
FIG. 1B is an illustration of a five conductor radio-frequency transmission line.
Figure 1C:
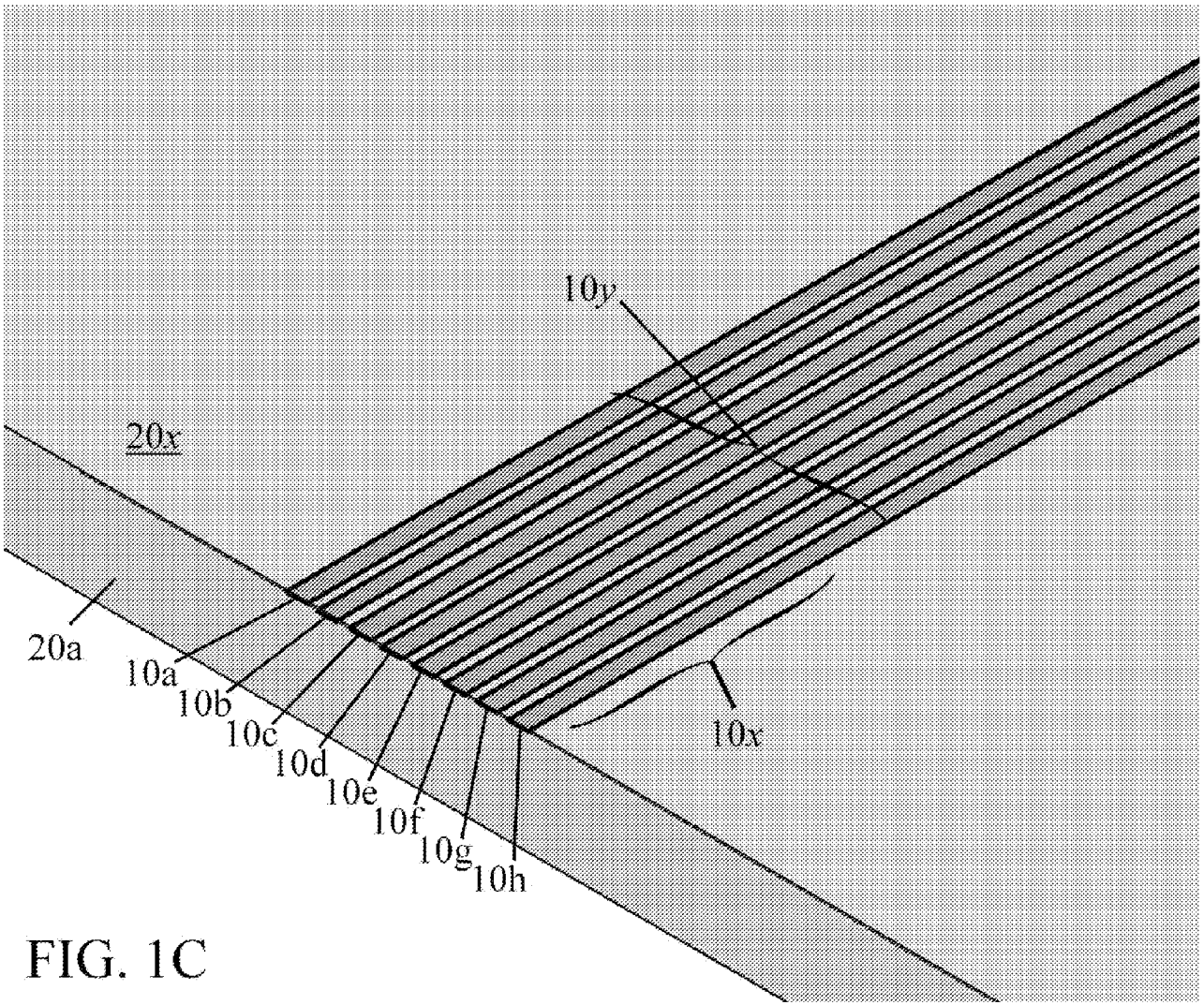
FIG. 1C is an illustration of an eight conductor radio-frequency transmission line.

With initial reference to FIGS. 1A-1C, a control line within a complex radio-frequency emission system, such as an active electrically scanned phase array antenna system or "AESA" system, generally constitutes a conductive trace 10*x* disposed on a dielectric 20*x*. Multiple control lines 10*a*, 10*b*, 10*c*, etc. may be arranged in parallel relationship on the surface of a layer of dielectric 20*a* in order to provide electrically independent paths for the conduction of low frequency control signals, i.e., signals having a frequency of less than 1 GHz, and typically less than 500 MHz. Such control signals may be used, for example, to control the phase varying electronics associated with the radio-frequency antenna elements in an AESA. The control signals may originate from a common controller, eventually fanning out to individual antenna elements in the antenna array (not shown). Typically, similar conductive traces, physically separated from the illustrated conductive trace 10*x*, would originate from a high frequency RF signal source, i.e., a controlled source of modulated microwave energy at any frequency that an AESA might be realized, and function as a low -loss RF transmission path to the RF emitters in the antenna array. The conductive traces would most typically be provided as striplines or microstrips disposed on a dielectric layer. However, if the conductive trace 10*x* is itself configured as a stripline or microstrip, then that conductive trace may support simultaneous single channel RF and single channel control signal transmission. In addition, although optionally, if the control signal is provided as a DC signal with a substantial voltage bias, a control system or other similar electronics may be supplied with DC power through the voltage differential between the conductive trace 10*x* and the ground plane of the stripline or microstrip configuration.

In the devices being disclosed, the conductive trace 10*x* is subdivided into a plurality of conductive traces 10*a*, 10*b*, 10*c*, etc. (collectively, 10*y*) disposed on a single layer of dielectric 20*x*. The plurality of conductive traces 10*y* functions as an RF waveguide (in the presence of a ground plane not shown for sake of clarity), with the multi-conductor transmission line consequently supporting simultaneous single channel RF and multiple channel control signal transmission. FIG. 1A shows an embodiment including a two conductor radio-frequency transmission line suitable for simultaneous single channel RF and two channel control signal transmission, while FIGS. 1B and 1C show embodiments including five and eight conductor radio-frequency transmission lines suitable for simultaneous single channel RF and four or eight channel control signal transmission, respectively. The embodiment shown in FIG. 1A may have a member line width of, for example, 11.5 mil, with an inter-line gap of 2 mil. On the other hand, the embodiments shown in FIGS. 1B and 1C may have a member line width of, for example, 4 mil and 2 mil, respectively, with an inter-line gap of 1 mil. At present, minimum member line widths of about 1.5 to 2 mil and minimum gap widths of about 0.5 to 1 mil should be used, so that the overall line width or footprint of the multi-conductor transmission line will begin to increase as the number of members in the plurality of conductive traces 10*y* increases. Such increases in line width may require increases in dielectric thickness in order to maintain the impedance characteristics of the transmission line and transmission line member conductors.

Figure 2:
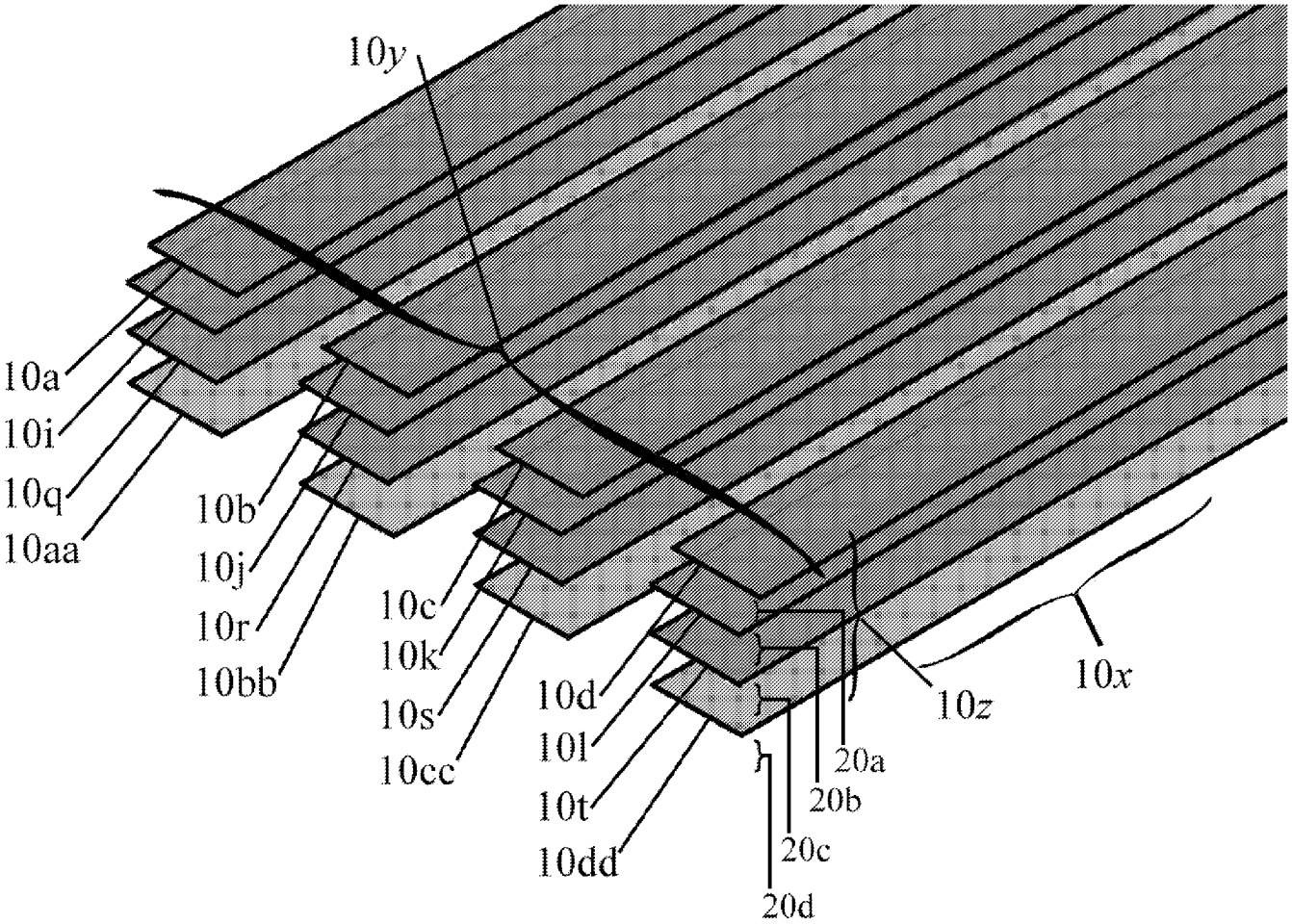
FIG. 2 is an illustration of a sixteen conductor radio-frequency transmission line including four stacks of conductors isolated by intermediate dielectric layers (not shown).

To restrict the overall line width or footprint of the multi-conductor transmission line, the conductive trace 10*x* may be subdivided into a plurality of conductive traces 10*a*, 10*i*, 10*q*, etc. (collectively, 10*z*) out of the plane of the layer of dielectric 20*a* so that a plurality of conductive traces 10*z*, disposed on separate layers of dielectric 20*a*, 20*b*, 20*c*, etc. (collectively, 20*x*) form a stacked multi-conductor transmission line. FIG. 2 shows an embodiment in which this arrangement is combined with the generally planar arrangements referenced in the prior paragraph to produce an extremely compact multi-conductor transmission line, such as the sixteen conductor radio-frequency transmission line shown in the figure. The embodiment shown in FIG. 2 may have a member line width of 4 mil, an inter-line gap width of 2 mil, and a "z" separation of 4 mil. A minimum "z" separation between conductive traces of about 1 mil should be used, however greater "z" separations, such as 10 mil or 20 mil, will permit an increase in the number of members and/or the member line width of the conductive traces disposed on each layer of dielectric 20*x* while preserving the impedance characteristics of the transmission line and transmission line member conductors.

To provide for simultaneous RF and control signal transmission, an input port 100 to the multi-conductor transmission line includes a segment of a radio-frequency signal input line 30 and a segment of the plurality of conductive traces 10*y* and/or 10*z* (hereafter 10*y/z*). The radio-frequency signal input line 30 is generally aligned with and disposed in a partially overlapping relationship with the plurality of conductive traces 10*y/z* at the input port 100 to provide capacitive coupling to the plurality of conductive traces 10 *y/z* at the input port 100. For sake of clarity, the term "partially overlapping" includes, and is not exclusive of, a completely overlapping relationship, and includes the interdigitated relationship described more fully below. Those of skill in the art will appreciate that the plurality of conductive traces 10*y/z* may otherwise be routed in any manner consistent with its function as an RF waveguide.

Figure 3:
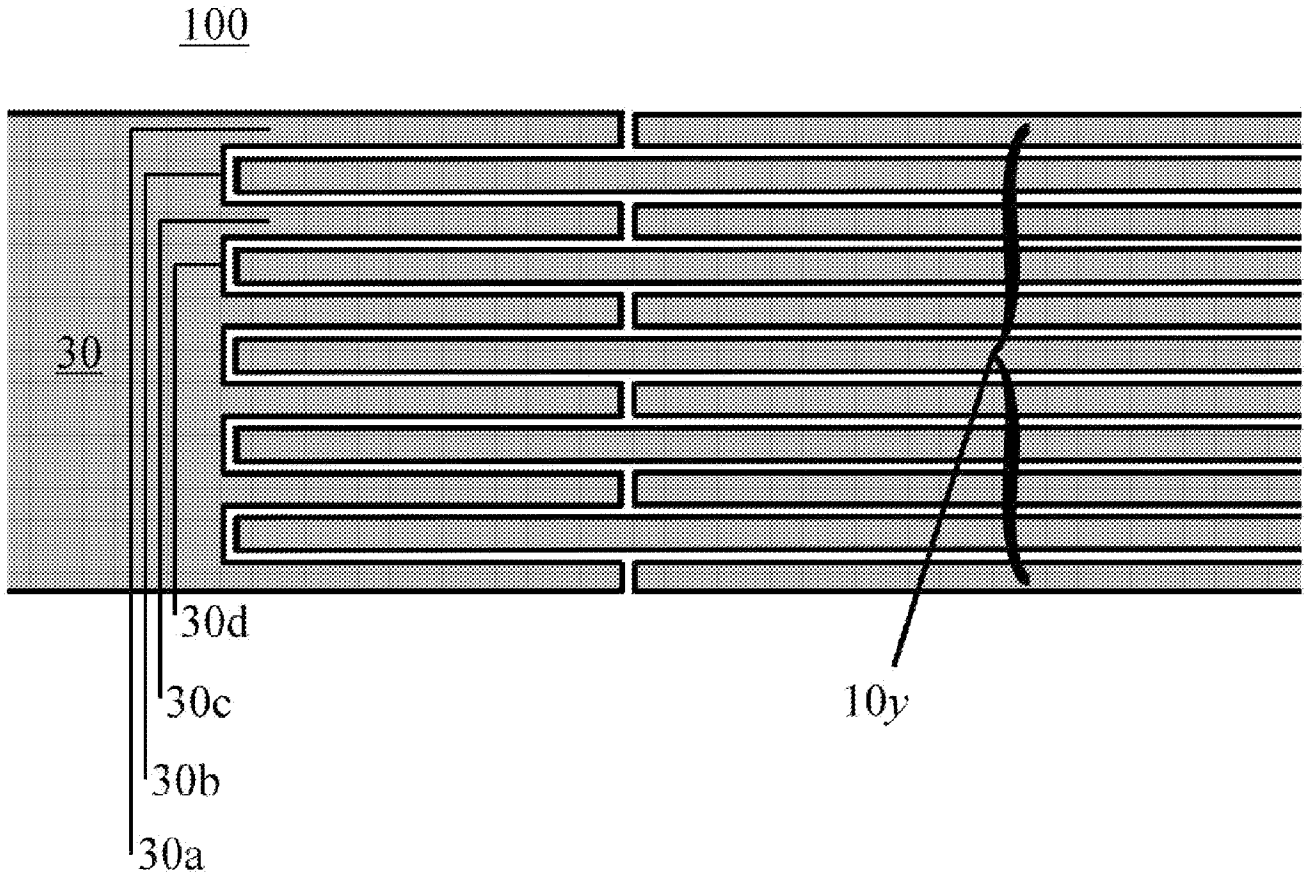
FIG. 3 is an illustration of an input port including a radio frequency input line disposed in a partially overlapping relationship with an eleven conductor radio-frequency transmission line.

In a first enablement, shown in FIG. 3, a plurality of conductive traces 10*y* may be configured to be interdigitated with the radio-frequency signal input line 30. Specifically, the radio-frequency signal input line 30 may provided with alternating projections and recesses, 30*a* (projection), 30*b*(recess), 30*c* (projection), 30*d* (recess), etc., and alternating elements of the plurality of conductive traces 10*y* may approximately abut the alternating structures of the radio-frequency signal input line 30. Those of skill in the art will appreciate that the radio-frequency signal input line 30 and plurality of conductive traces 10*y* will not contactingly abut each other due to the need to provide capacitive, rather than conductive, coupling between the respective lines. This capacitive coupling is configured as a high-pass filter to permit radio-frequency energy to couple between the respective lines, but prevent control signals and/or DC power from passing between the respective lines. Those of skill in the art will also appreciate that an interdigitated configuration may be used to couple a radio-frequency signal input line 30 and a plurality of conductive traces 10*z*, i.e., in a stacked multi-conductor transmission line, as well as in stacked multi-conductor transmission lines having combined arrangements similar to that shown in FIG. 2. The radio-frequency signal input line 30 in these configurations should be at least as wide as the plurality of conductive traces, i.e., have at least the same overall line width or footprint.

Figure 4:
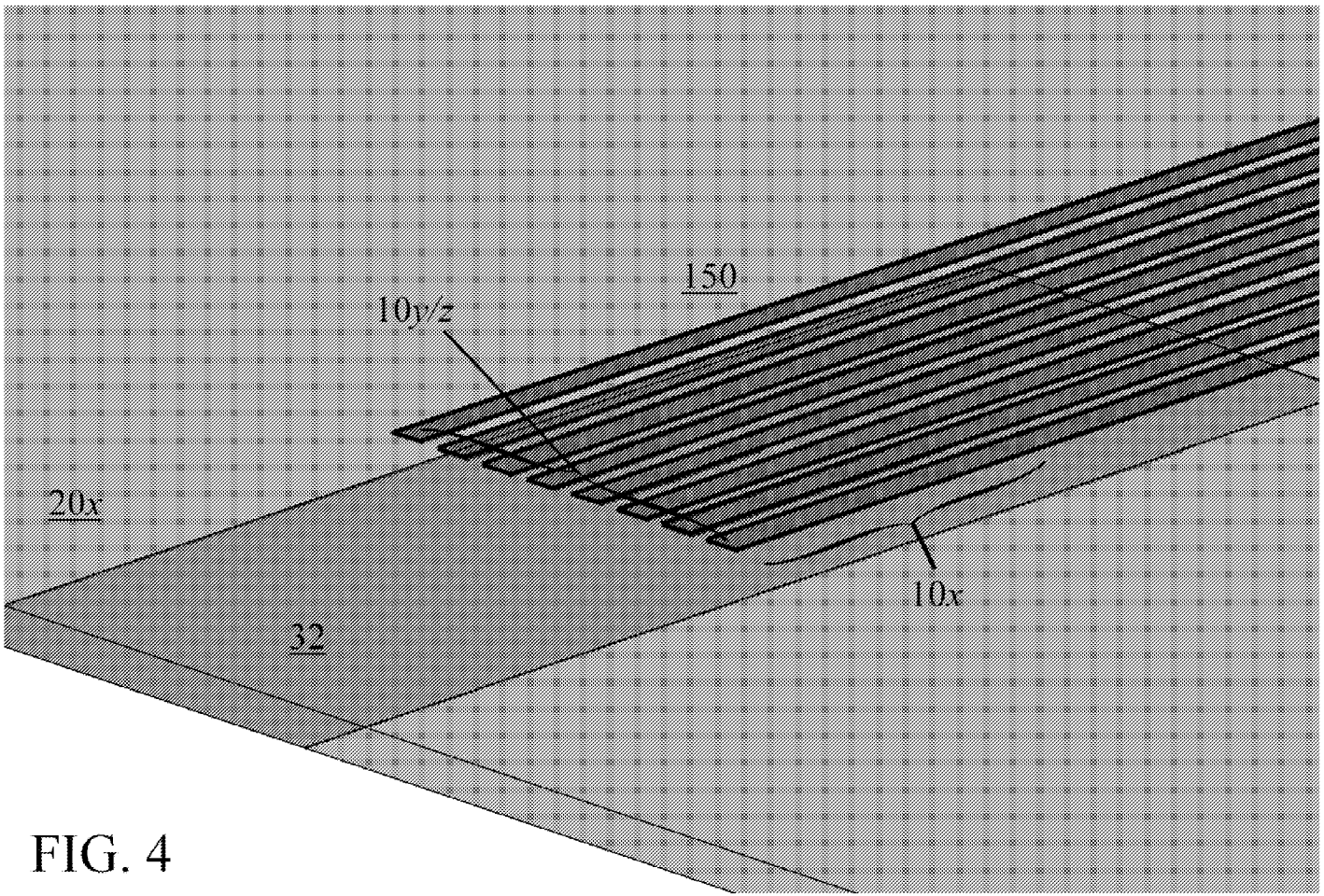
FIG. 4 is an illustration of an output port including a radio frequency output line disposed in a completely overlapping relationship with an eight conductor radio-frequency transmission line.

In a second enablement, shown in FIG. 4, a plurality of conductive traces 10*y* may be completely overlapped by the radio-frequency signal input line 30. Those of skill in the art will of course appreciate that the radio-frequency signal input line 30 and plurality of conductive traces 10*y* will not contactingly overlap each other due to the need to provide capacitive, rather than conductive, coupling between the respective lines. Again, this capacitive coupling is configured as a high-pass filter to permit radio-frequency energy to couple between the respective lines, but prevent control signals and/or DC power from passing between the respective lines. Those of skill in the art will also appreciate that the radio-frequency signal input line 30 may completely overlap a plurality of conductive traces 10*z*, i.e., a stacked multi-conductor transmission line, as well as stacked multi-conductor transmission lines having combined arrangements similar to that shown in FIG. 2. The radio-frequency signal input line 30 in this configuration should again be at least as wide as the plurality of conductive traces.

In either enablement, capacitive coupling between the radio-frequency signal input line 30 and a plurality of conductive traces 10*y/z* produces a multi-conductor structure capable of simultaneously distributing primary radio-frequency signals and secondary control signals from the input port to one or more output ports 150. If only one output port 150 is used, every member of the plurality of conductive traces 10*y/z* may be routed to the output port 150, which would be configured similarly to the input ports 100 described above (but with an output line 32), and preferably essentially identically to the input port 100 of the particular configuration. If multiple output ports 150 are used to provide a one-to-many RF distribution network, at least one member of the plurality of conductive traces 10*y/z* may be routed to each output port 150, with each output port configured similarly to the input ports 100 described above, but including only a subset of the plurality of conductive traces 10*y/z*. For sake of clarity, the multiple conductor radio-frequency transmission line may include various combinations of input ports 100 and output ports 150 so as to provide a 1-to-1, 1-to-many, many-to-1, or many-to-many RF distribution network.

The terminal ends of the plurality of conductive traces 10*y/z*, i.e., those segments not disposed within or between an input port 100 and an output port 150, continue to conduct low frequency control signals and, optionally, DC power, as they would in a non-integrated network. Preferably, the terminal ends include low-pass filter structures, such as a ninety degree bend leading to an RF choke, configured to permit control signals and/or DC power to conduct along the plurality of conductive traces 10*y/z* while blocking high frequency RF signals from propagating past the configuration and into controllers or antenna control elements. Those of skill in the art will appreciate that other low-pass filter structures known in the art may be substituted for this exemplary filter structure in accordance with the needs of the design or the preferences of the designer.

The transmission characteristics of a number of exemplary configurations have been simulated in HFSS, published by Ansoft LLC of Pittsburgh, Pa. The reader will appreciate that the following examples are representative of the disclosed devices, but do not constitute or otherwise limit the envisioned scope of the aspects, embodiments, and enablements otherwise discussed herein.

Example 1

Figure 5:
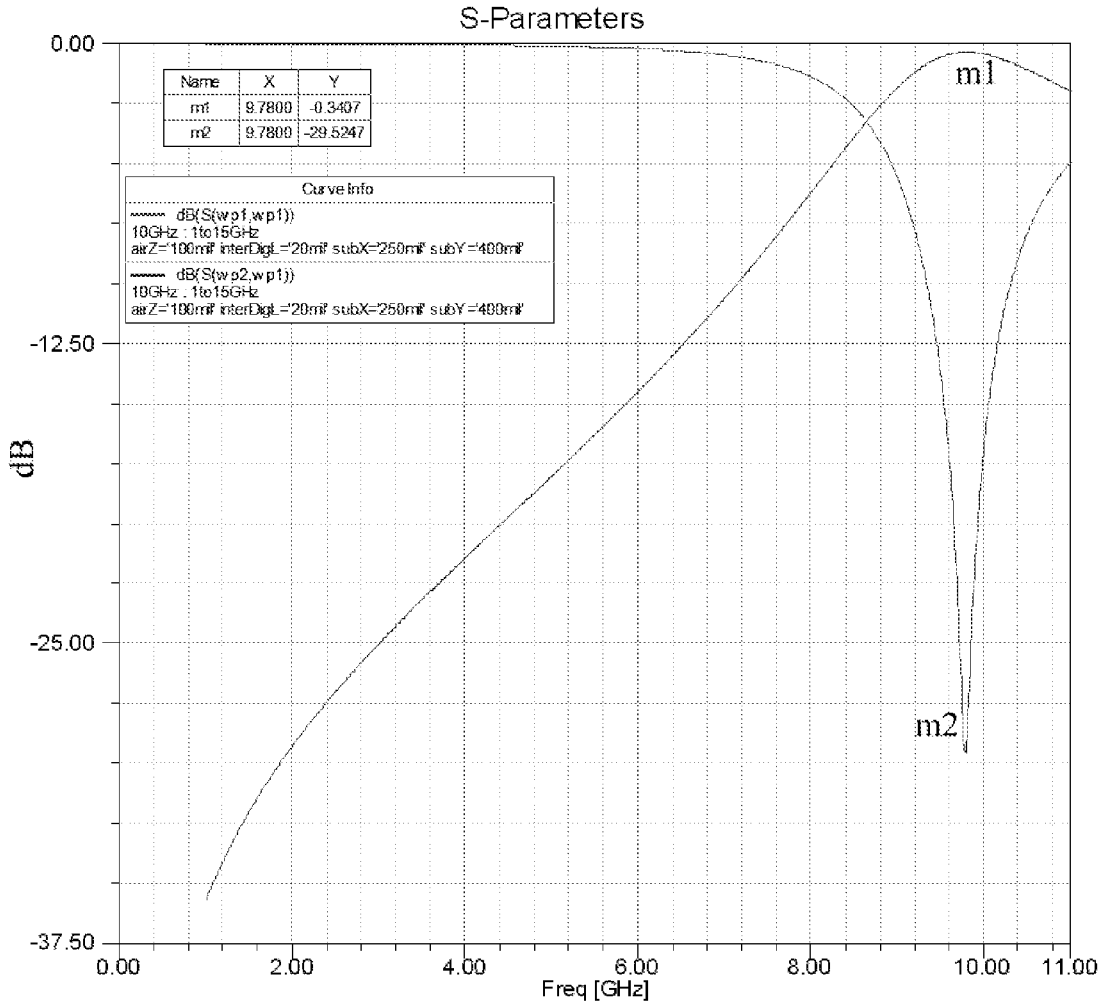
FIG. 5 is a graph of the S-parameters of a first exemplary configuration.
Figure 5:
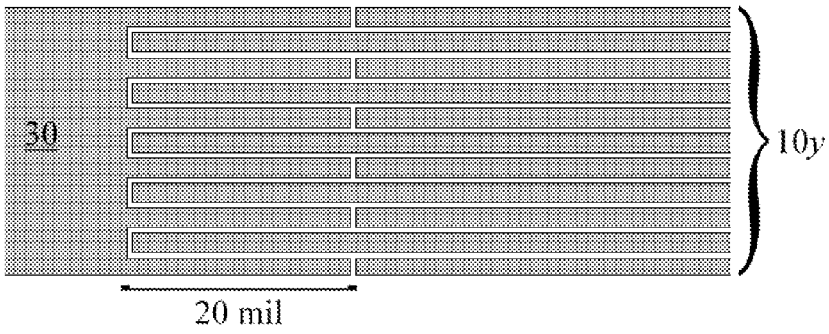

A multiple conductor radio-frequency transmission line consisting of 11 conductive traces with a member line width of 1.75 mil and inter-line gap of 0.5 mil was simulated with an input port p1 consisting of a partially overlapping, interdigitated connection with an radio-frequency signal input line having an equal overall line width of 24 mil, and an output port p2 consisting of an essentially identical interdigitated connection with a radio-frequency signal output line having an equal overall line width of 24 mil. A dielectric layer of 10 mil thickness was used to maintain an transmission line impedance of 50 ohms. Radio frequency transmission efficiency, graphed as line m1, and reflection, graphed as line m2, was calculated from 1 GHz to 11 GHz. These simulation results appear in FIG. 5. With a 20 mil interdigitation length, peak transmission efficiency arose at 9.78 GHz with a loss of about 0.3 dB, and minimum reflection arose at essentially the same frequency with a return of about −29.5 dB.

Example 2

Figure 6:
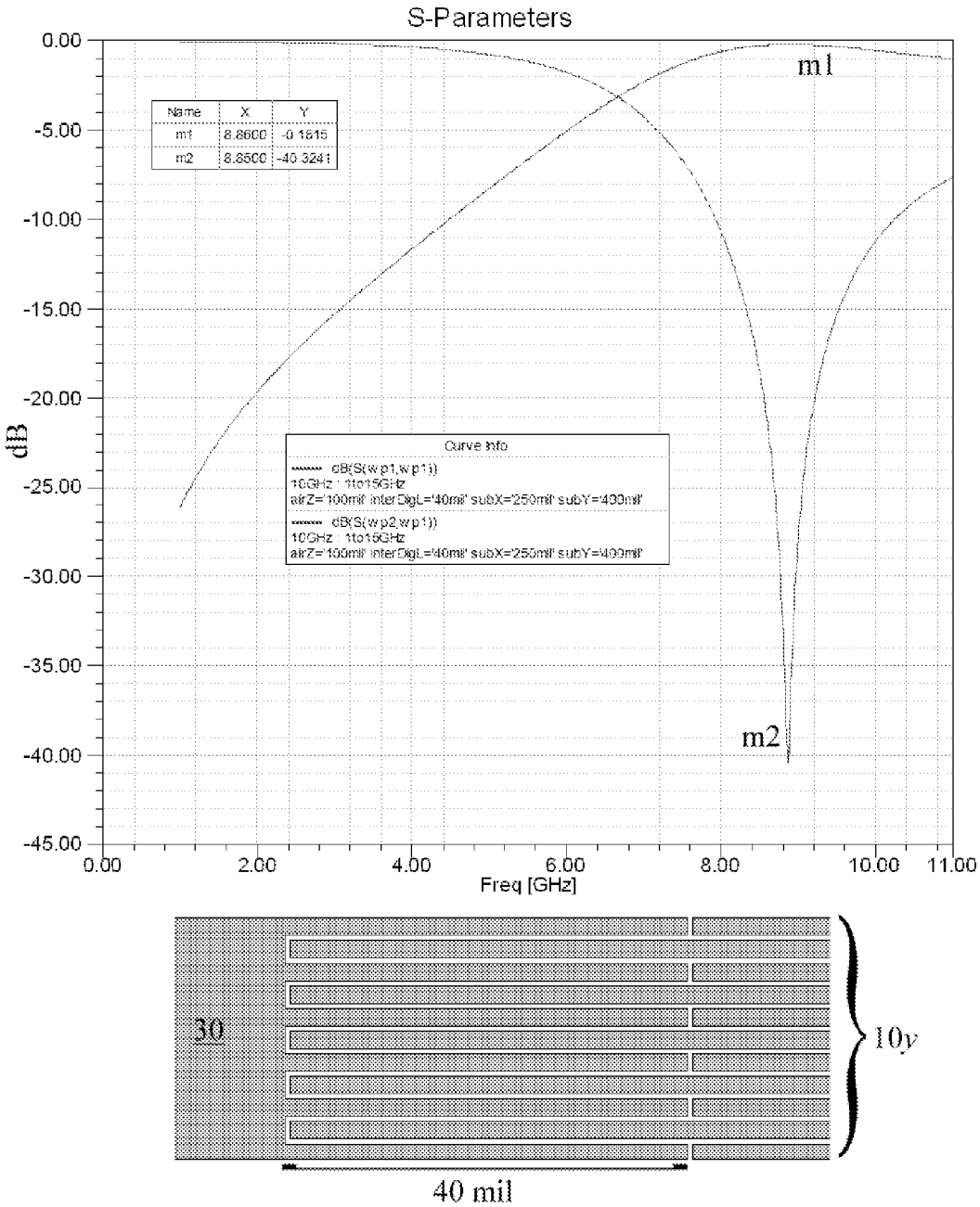
FIG. 6 is a graph of the S-parameters of a second exemplary configuration.

The multiple conductor radio-frequency transmission line of the first example was altered to have a 40 mil interdigitation length. Radio frequency transmission efficiency, graphed as line m1, and reflection, graphed as line m2, was calculated from 1 GHz to 11 GHz. These simulation results appear in FIG. 6. With the 40 mil interdigitation length, peak transmission efficiency arose at 8.86 GHz with a loss of about 0.2 dB, and minimum reflection arose at essentially the same frequency with a return of about −40.3 dB. As illustrated by Examples 1 and 2, capacitive coupling efficiency at a target frequency can be adjusted by varying parameters such as interdigitation length.

Example 3

Figure 7:
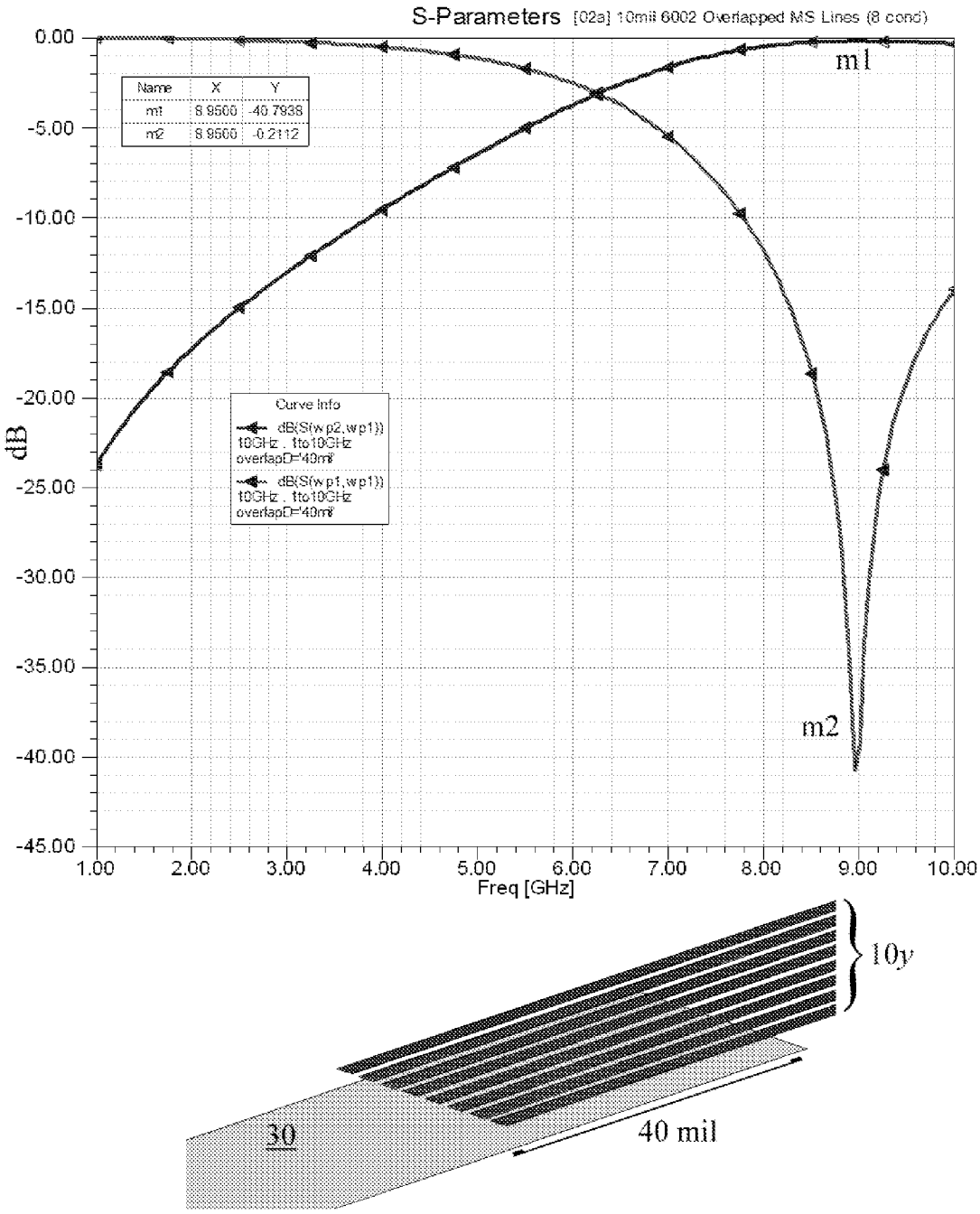
FIG. 7 is a graph of the S-parameters of a third exemplary configuration.

A multiple conductor radio-frequency transmission line consisting of 8 conductive traces with a member line width of 2 mil and inter-line gap of 1 mil was simulated with an input port p1 consisting of a completely overlapping, non-interdigitated connection with an radio-frequency signal input line having an equal overall line width of 23 mil, and an output port p2 consisting of an essentially identical non-interdigitated connection with a radio-frequency signal output line having an equal overall line width of 23 mil. A dielectric layer of 10 mil thickness was used to maintain an transmission line impedance of 50 ohms. Radio frequency transmission efficiency, graphed as line m1, and reflection, graphed as line m2, was calculated from 1 GHz to 11 GHz. These simulation results appear in FIG. 7. With a 40 mil overlap length, peak transmission efficiency arose at 8.95 GHz with a loss of about 0.2 dB, and minimum reflection arose at essentially the same frequency with a return of about −40.8 dB.

Example 4

Figure 8:
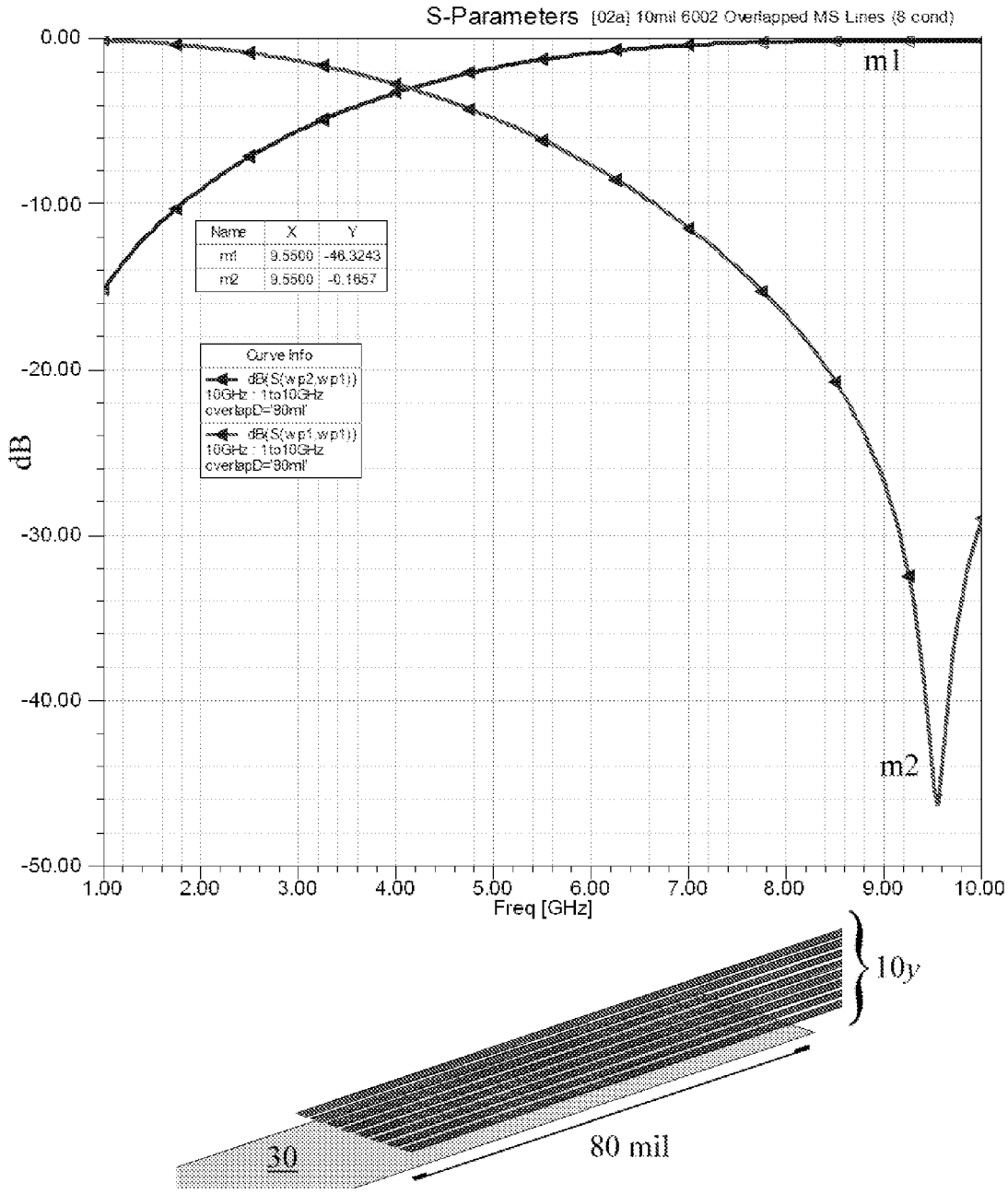
FIG. 8 is a graph of the S-parameters of a fourth exemplary configuration.

The multiple conductor radio-frequency transmission line of the third example was altered to have an 80 mil overlap length. Radio frequency transmission efficiency, graphed as line m1, and reflection, graphed as line m2, was calculated from 1 GHz to 11 GHz. These simulation results appear in FIG. 8. With the 80 mil overlap length, peak transmission efficiency arose at 9.55 GHz with a loss of about 0.2 dB, and minimum reflection arose at essentially the same frequency with a return of about −46.3 dB. As illustrated by Examples 3 and 4, capacitive coupling efficiency at a target frequency can also be adjusted by varying parameters such as overlap length.

Example 5

Figure 9:
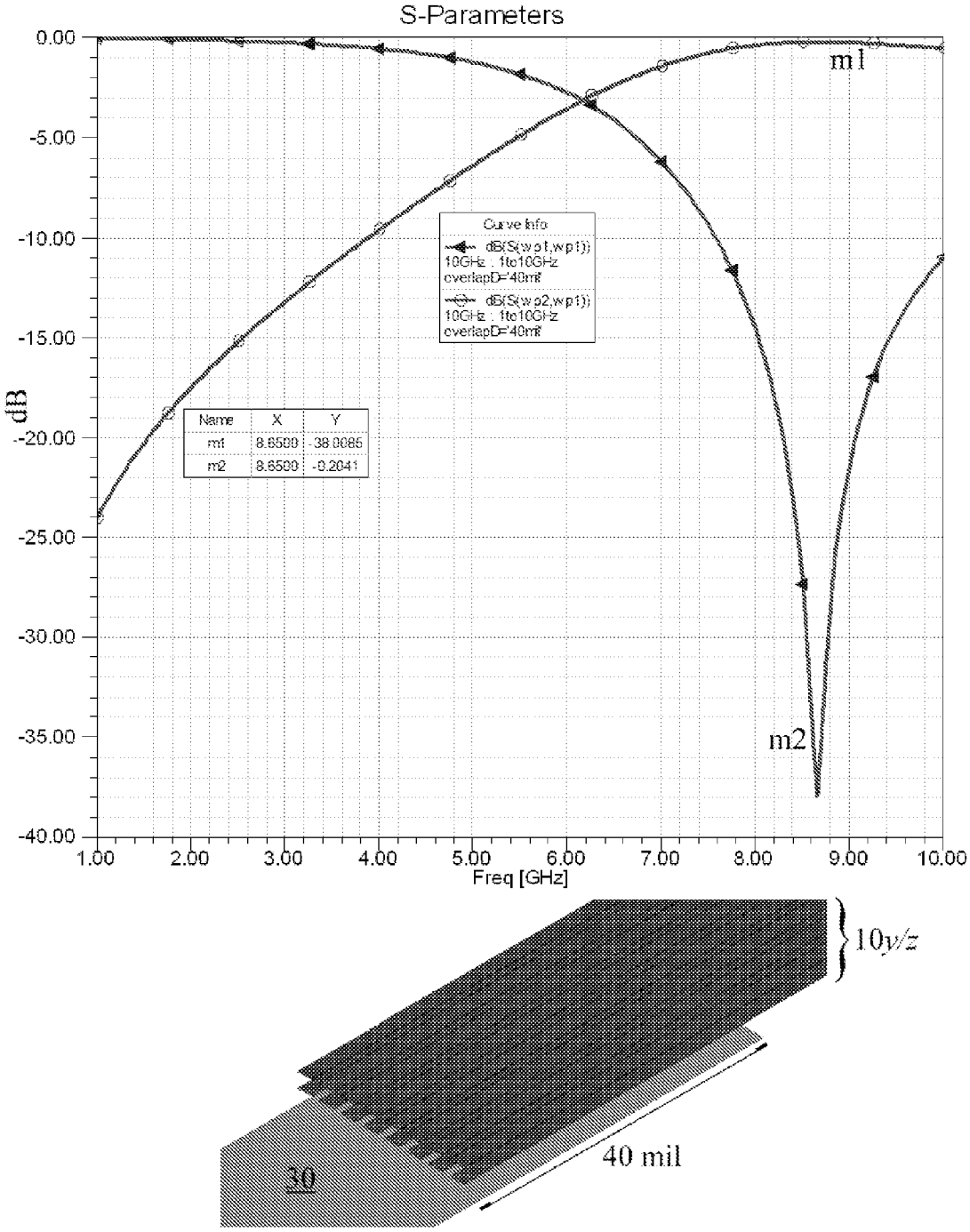
FIG. 9 is a graph of the S-parameters of a fifth exemplary configuration.

The multiple conductor radio-frequency transmission line of the third example was altered to have a stacked multi-conductor transmission line including two layers of 8 conductive traces with a "z" separation of 2 mil. Radio frequency transmission efficiency, graphed as line m1, and reflection, graphed as line m2, was calculated from 1 GHz to 11 GHz. These simulation results appear in FIG. 9. With the 40 mil overlap length, peak transmission efficiency arose at 8.86 GHz with a loss of about 0.2 dB, and minimum reflection arose at essentially the same frequency with a return of about −40.3 dB. In comparison with Example 3, control signal capacity is doubled with only minor changes in optimal frequency, peak transmission efficiency, and minimum reflection. Only minor changes in S-parameters are seen across the relevant frequency spectrum as a whole.

Example 6

Figure 10:
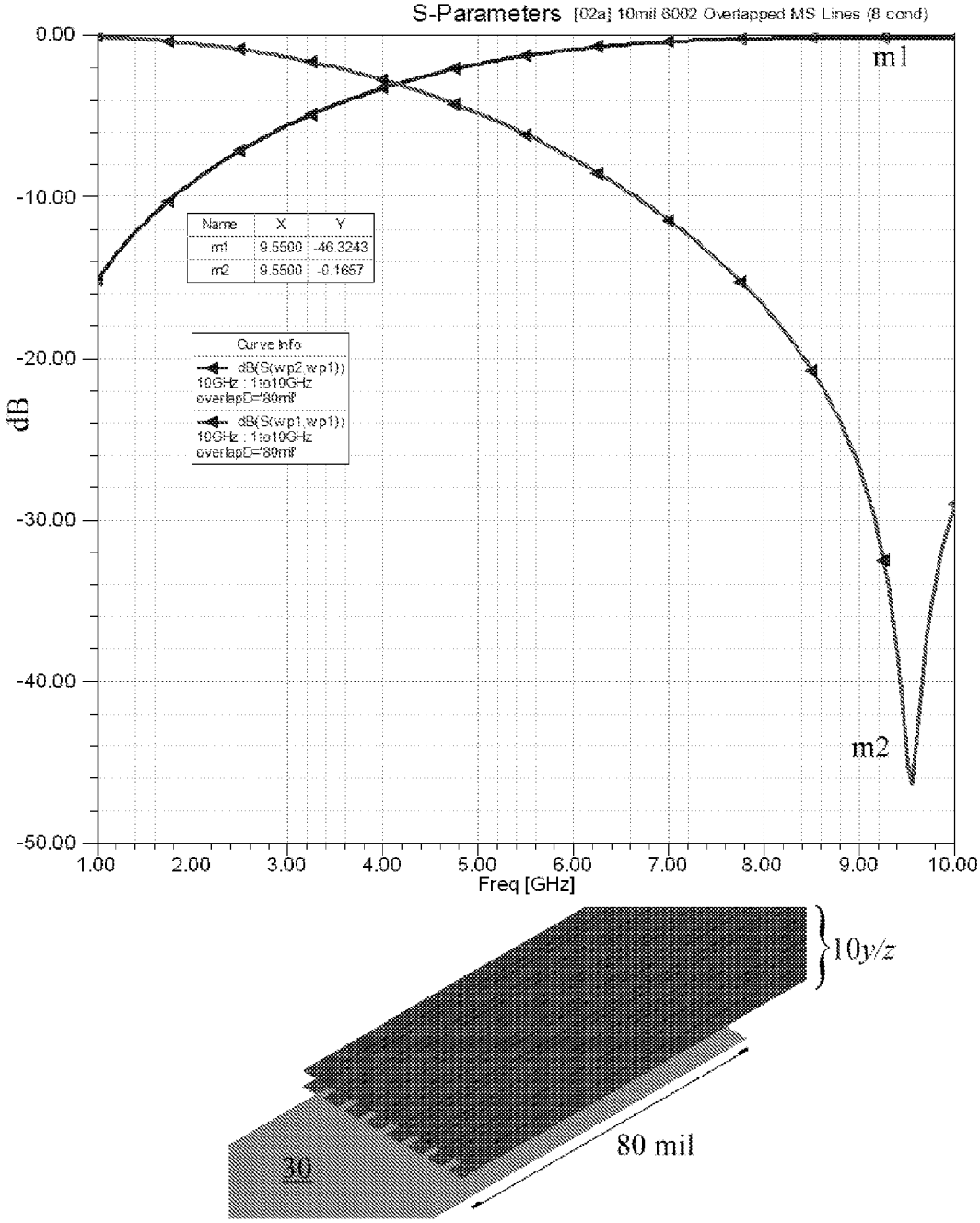
FIG. 10 is a graph of the S-parameters of a sixth exemplary configuration.

The multiple conductor radio-frequency transmission line of the fifth example was altered to have an 80 mil overlap length. Radio frequency transmission efficiency, graphed as line m1, and reflection, graphed as line m2, was calculated from 1 GHz to 11 GHz. These simulation results appear in FIG. 10. With the 80 mil overlap length, peak transmission efficiency arose at 9.00 GHz with a loss of about 0.2 dB, and minimum reflection arose at essentially the same frequency with a return of about −46.0 dB. In comparison with Example 4, control signal capacity is again doubled with only minor changes in optimal frequency, peak transmission efficiency, and minimum reflection. Only minor changes in S-parameters are seen across the relevant frequency spectrum as a whole.

Example 7

Figure 11:
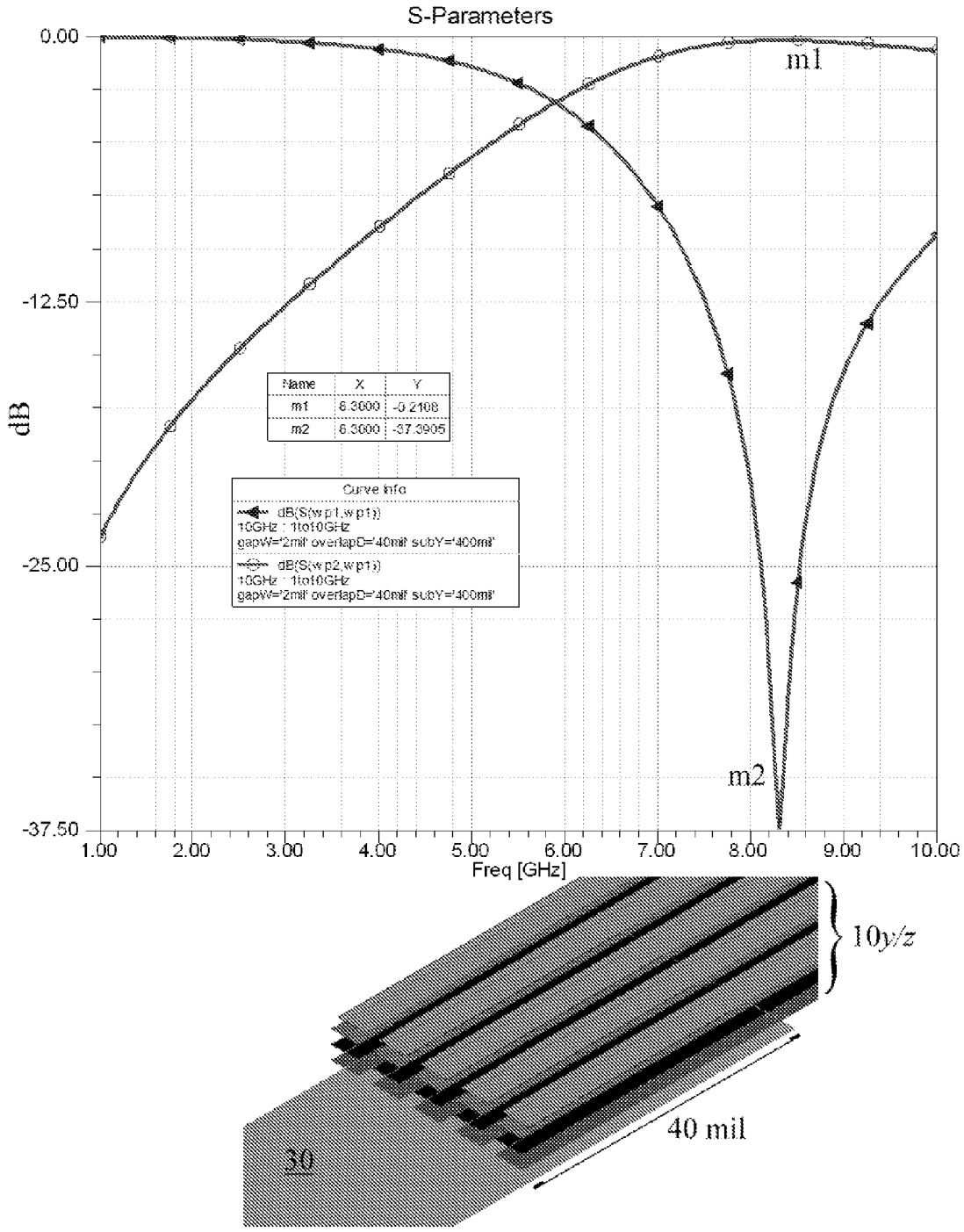
FIG. 11 is a graph of the S-parameters of a seventh exemplary configuration.
Figure 12:
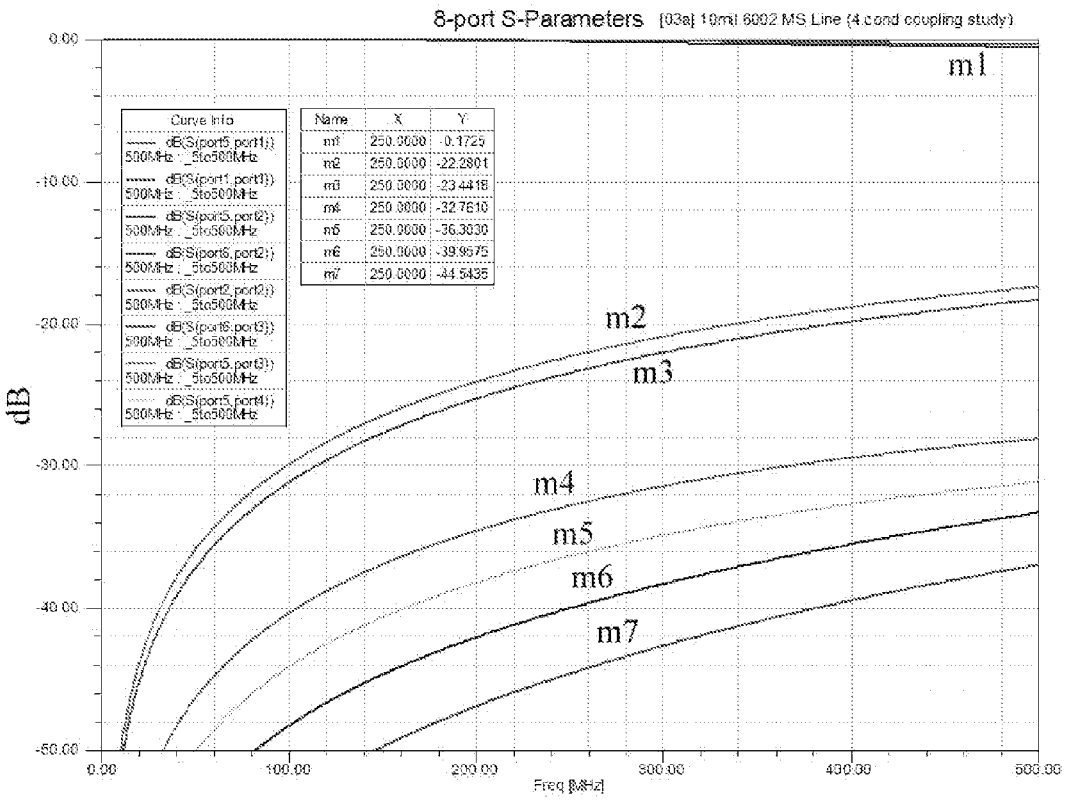
FIG. 12 is a graph of the S-parameters of an eighth exemplary configuration
Figure 12:
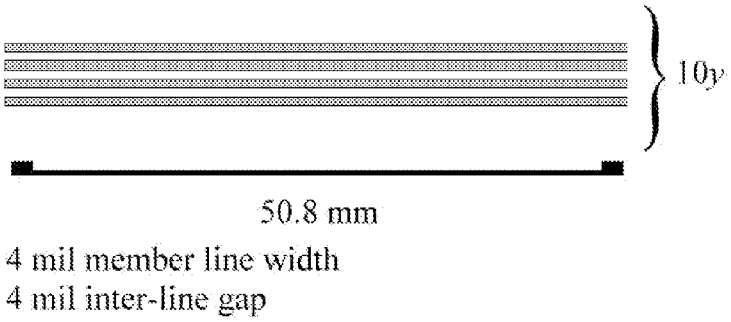

A multiple conductor radio-frequency transmission line consisting of 20 conductive traces with a member line width of 4 mil and inter-line gap of 2 mil, arranged as 4 layers of conductive traces with 5 conductive traces per layer and a "z" separation of 2 mil, was simulated with an input port p1 consisting of a completely overlapping, non-interdigitated connection with an radio-frequency signal input line having an equal overall line width of 28 mil, and an output port p2 consisting of an essentially identical non-interdigitated connection with a radio-frequency signal output line having an equal overall line width of 28 mil. Radio frequency transmission efficiency, graphed as line m1, and reflection, graphed as line m2, was calculated from 1 GHz to 11 GHz. These simulation results appear in FIG. 11. With a 40 mil overlap length, peak transmission efficiency arose at 8.30 GHz with a loss of about 0.2 dB, and minimum reflection arose at essentially the same frequency with a return of about −37.4 dB. While the optimal frequency of the transmission line is moderately lower than those found in Examples 1-6, control signal capacity is greatly increased with little change in overall line width or footprint in comparison to the multiple conductor radio-frequency transmission lines of those examples.

Example 8

Control Signal Characteristics

A multiple conductor radio-frequency transmission line segment, two inches long, consisting of 4 conductive traces with a member line width of 4 mil and an inter-line gap of 4 mil, was simulated to characterize the S-parameters of control signals in traces configured as a multiple conductor radio-frequency transmission line. Control signal transmission efficiency, graphed as line m1; reflection within an inner and outer conductive trace, graphed as lines m2 and m3, respectively; cross-talk between an outer conductive trace and (in order of adjacency) the other conductive traces, graphed as lines m6, m5, and m4, respectively; and cross-talk between inner conductive traces, graphed as line m7, was calculated from 5 MHz to 500 MHz. While these values are specific to the described two inch segment, they also provide order of magnitude information about the coupling of control signals between relevant lengths of multi-conductor transmission line.

The various aspects, embodiments, enablements, and exemplary constructions described above are intended to be illustrative in nature, and are not intended to limit the scope of the invention. Any limitations to the invention will appear in the claims as allowed in view of the terms explicitly defined herein.

What is claimed is:

1. A multiple conductor radio-frequency transmission line comprising:

a plurality of conductive traces forming electrically independent paths between an input port and at least one output port, the plurality of conductive traces conducting a plurality of secondary control signals between the input port and the at least one output port;

the input port including a radio-frequency signal input line which is generally aligned with and disposed in a partially overlapping relationship with the plurality of conductive traces at the input port, with the radio-frequency signal input line being at least as wide as the plurality of conductive traces at the input port; and the at least one output port including a radio-frequency signal output line which is generally aligned with and disposed in a partially overlapping relationship with at least one of the plurality of conductive traces at the at least one output port, with the radio-frequency signal output line being at least as wide as the at least one of the plurality of conductive traces at the output port;

whereby the input and output ports provide a capacitively coupled, multiple conductor structure capable of simultaneously distributing primary, higher-frequency radio-frequency signals and secondary, lower-frequency control signals from the input port to one or more output ports.

2. The multiple conductor radio-frequency transmission line of claim 1, wherein the plurality of conductive traces is disposed on a common layer of dielectric material.

3. The multiple conductor radio-frequency transmission line of claim 1, wherein the plurality of conductive traces is disposed on separate layers of dielectric material so as to form a stacked multiple conductor radio-frequency transmission line.

4. The multiple conductor radio-frequency transmission line of claim 1, wherein the plurality of conductive traces is, in part, disposed on a common layer of dielectric material and, in part, disposed on separate layers of dielectric material so as to form a stacked multiple conductor radio-frequency transmission line having multiple conductive traces per layer.

5. The multiple conductor radio-frequency transmission line of claim 1, wherein the radio-frequency signal input line and the plurality of conductive traces at the input port are partially overlapping in an interdigitated relationship.

6. The multiple conductor radio-frequency transmission line of claim 1, wherein the radio-frequency signal input line and the plurality of conductive traces at the input port are partially overlapping in a completely overlapping relationship.

7. The multiple conductor radio-frequency transmission line of claim 1, wherein the at least one output port is the only output port, and wherein the radio-frequency signal output line is generally aligned with and disposed in a partially overlapping relationship with the plurality of conductive traces at the at least one output port, and wherein the input port and the output port are configured essentially identically.

8. The multiple conductor radio-frequency transmission line of claim 1, wherein a terminal end of the plurality of conductive traces, not disposed within or between the input port and the at least one output port, includes a low-pass filter structure configured to permit the secondary, lower-frequency control signals to conduct along the plurality of conductive traces while blocking the primary, higher-frequency radio-frequency signals from propagating beyond the low-pass filter structure.

9. The multiple conductor radio-frequency transmission line of claim 8, wherein the low-pass filter structure comprises a ninety degree bend leading to a radio-frequency choke.

10. A multiple conductor radio-frequency transmission line comprising:

a plurality of conductive traces forming an impedance matched conduit for the transmission of a high frequency radio signal along electrically independent paths;

a capacitively coupled input port providing high-pass coupling of the high frequency radio signal between the plurality of conductive traces and a radio-frequency signal input line at the input port, with the radio-frequency signal input line being generally aligned with and at least as wide as the plurality of conductive traces at the input port; and a capacitively coupled output port providing high-pass coupling of the high frequency radio signal between the plurality of conductive traces and a radio-frequency signal output line at the output port, with the radio-frequency signal output line being generally aligned with and at least as wide as the plurality of conductive traces at the output port.

11. The multiple conductor radio-frequency transmission line of claim 10, wherein the plurality of conductive traces is disposed on a common layer of dielectric material.

12. The multiple conductor radio-frequency transmission line of claim 10, wherein the plurality of conductive traces is disposed on separate layers of dielectric material so as to form a stacked multiple conductor radio-frequency transmission line.

13. The multiple conductor radio-frequency transmission line of claim 10, wherein the plurality of conductive traces is, in part, disposed on a common layer of dielectric material and, in part, disposed on separate layers of dielectric material so as to form a stacked multiple conductor radio-frequency transmission line having multiple conductive traces per layer.

14. The multiple conductor radio-frequency transmission line of claim 10, wherein the radio-frequency signal input line and the plurality of conductive traces at the input port are capacitively coupled through an interdigitated relationship.

15. The multiple conductor radio-frequency transmission line of claim 10, wherein the radio-frequency signal input line and the plurality of conductive traces at the input port are capacitively coupled through an at least partially overlapping relationship.

16. The multiple conductor radio-frequency transmission line of claim 10, wherein the radio-frequency signal input line and the plurality of conductive traces at the input port are capacitively coupled through a completely overlapping relationship between the radio-frequency signal input line and the members of the plurality of conductive traces at the input port.

17. The multiple conductor radio-frequency transmission line of claim 10, wherein the input port and the output port are configured essentially identically.

18. A multiple conductor radio-frequency transmission line comprising:

a plurality of conductive traces forming an impedance matched conduit for the transmission of a high frequency radio signal along electrically independent paths;

a capacitively coupled input port providing high-pass coupling of the high frequency radio signal between the plurality of conductive traces and a radio-frequency signal input line at the input port, with the radio-frequency signal input line being generally aligned with and at least as wide as the plurality of conductive traces at the input port; and a capacitively coupled output port providing high-pass coupling of the high frequency radio signal between the plurality of conductive traces and a radio-frequency signal output line at the output port, with the radio-frequency signal output line being generally aligned with and at least as wide as the plurality of conductive traces at the output port;

wherein the plurality of conductive traces conduct a plurality of secondary control signals between the input port and the at least one output port, and wherein a terminal end of the plurality of conductive traces, not disposed within or between the input port and the at least one output port, includes a low-pass filter structure configured to permit the secondary control signals to conduct along the plurality of conductive traces while blocking the high frequency radio signal from propagating beyond the low-pass filter structure.

19. The multiple conductor radio-frequency transmission line of claim 18, wherein the low-pass filer structure comprises a ninety degree bend leading to an RF choke.

* * * * *